US007353891B2

(12) United States Patent
Nolan

(10) Patent No.: US 7,353,891 B2
(45) Date of Patent: Apr. 8, 2008

(54) SYSTEMS AND METHODS FOR THE INSTALLATION OF EARTH ANCHORS

(76) Inventor: Philip D. Nolan, 230 E. 8th St., Herman, MO (US) 65041

( * ) Notice: Subject to any disclaimer, the term of this patent is extended or adjusted under 35 U.S.C. 154(b) by 348 days.

(21) Appl. No.: 10/892,972

(22) Filed: Jul. 16, 2004

(65) Prior Publication Data

US 2005/0074299 A1 Apr. 7, 2005

Related U.S. Application Data

(60) Provisional application No. 60/488,601, filed on Jul. 18, 2003.

(51) Int. Cl.
*E21B 7/00* (2006.01)

(52) U.S. Cl. ..... 175/323; 403/378; 403/379.4

(58) Field of Classification Search ..... 403/109.3, 403/109.6, 324, 325, 306, 378, 379.4; 175/323
See application file for complete search history.

(56) References Cited

U.S. PATENT DOCUMENTS

| | | | | |
|---|---|---|---|---|
| 2,883,223 | A | | 4/1959 | Petersen |
| 3,148,510 | A | | 9/1964 | Sullivan |
| 3,148,739 | A | | 9/1964 | Mattingly et al. |
| 3,377,077 | A | | 4/1968 | Hollander et al. |
| 3,561,545 | A | * | 2/1971 | Rassieur ..... 173/166 |
| 3,896,890 | A | | 7/1975 | Gale |
| 3,952,523 | A | | 4/1976 | Gale |
| 4,239,419 | A | | 12/1980 | Gillen |
| 4,334,392 | A | | 6/1982 | Dziedzic |
| 4,580,795 | A | | 4/1986 | Burtelson et al. |
| 5,145,286 | A | * | 9/1992 | Summers ..... 405/259.1 |
| 5,476,149 | A | | 12/1995 | Rickards |
| 5,904,447 | A | | 5/1999 | Sutton et al. |
| 6,050,740 | A | | 4/2000 | Dziedzic |
| 6,681,871 | B2 | | 1/2004 | Drumm et al. |
| 7,188,684 | B2 | | 3/2007 | Nolan |

* cited by examiner

*Primary Examiner*—William P Neuder
(74) *Attorney, Agent, or Firm*—Lewis, Rice & Fingersh, L.C.

(57) ABSTRACT

An adapter attachment for an auger which includes an connecting shaft sized and shaped to be attached to the pilot bit hole present in the end of an auger, after the removal of pilot bit. The adapter also includes a bolt flange for connection to a foundation anchor installation plate/tool such as a locking dog assembly. The adapter obviates the need to remove the auger from the Kelly bar during anchor installation. A modification includes eliminating the bolt flange and placing the connecting shaft directly to the locking dog assembly to form a pilot hole locking dog.

10 Claims, 7 Drawing Sheets

SYSTEMS AND METHODS FOR THE INSTALLATION OF EARTH ANCHORS

CROSS REFERENCE TO RELATED APPLICATION(S)

This application claims priority to U.S. Provisional Application Ser. No. 60/488,601 filed Jul. 18, 2003, the entire disclosure of which is herein incorporated by reference.

BACKGROUND OF THE INVENTION (1) Field of the Invention

The present invention pertains to an adapter for attachment to the pilot bit hole of an auger to install anchors into the earth.

(2) Background of the Invention

Utility poles and other tall narrow structures are generally secured by both being placed deep into the earth that supports them and then anchoring them through the use of extending guide wires. The guide wires provide for support to prevent the structure from levering itself from its hole in the earth. The guide wires will generally extend from an upper portion of the pole or structure and will be connected to a device which will hold their opposing end to the earth at a distance from the base of the pole or structure. The device is generally referred to as an "anchor" and the anchor and guide wire arrangement prevents movement of the upper portion of the structure which could act to lever the structure through the ground tipping it over.

A myriad of anchor assemblies are available for use in different types of soils and substances and for different types of applications. One particularly common type of anchor used in the support of utility poles and other pole-like or tower structures is the screw type anchor (10) such as that shown in FIG. 1 and in U.S. Pat. No. 3,148,510 the entire disclosure of which is herein incorporated by reference. The screw type anchor (10) incorporates at least one screw flange (11) generally arranged toward the lower end (13) of the anchor (10) and a guy rod (15) which extends upwards from the screw flange (11) and is screwed or otherwise attached thereto. The guy rod (15) will generally terminate at its upper end (14) in a connector (17). The connector (17) will often be an externally threaded shaft (19) with a shoulder (21). While anchors (10) are particularly useful for the installation of guide wires, they are also used for the direct installation of tall structures (particularly those which are narrow and lack other foundations) such as street lights, transformers, bumper posts, and signs.

Anchors of this type are regularly installed in conjunction with the erection of a utility pole. An auger truck carries and controls the auger for drilling the pole's hole and includes a derrick structure for transferring rotary motion from a motor on board the auger truck to whatever object is attached to the derrick. The attachment will generally be at the terminal end of the derrick and will generally be a Kelly bar. The Kelly bar may be comprised of multiple segments connected together. When an auger is in use on the derrick, generally one of the segments of Kelly bar will extend through the central shaft of the auger and the auger will be attached toward the derrick and toward the top of the Kelly bar. If additional length is needed for the auger from the derrick (for instance in deep installations or when the truck is positioned on a hill or other inclined area), the auger may be positioned so that it is attached at the terminal end of the Kelly bar, instead of having the Kelly bar extend through the shaft of the auger, to provide for additional length to the auger from the derrick.

To install an anchor in conjunction with a pole placement, the auger needs to be removed from the Kelly bar to allow access to the Kelly bar. To remove the auger, the auger may be either directly manhandled by a worker (or more than one worker in most cases) or, if the installation is in an area where disturbing nearby earth is not a problem, the auger may be partially drilled into the ground to support it after it is disconnected. This later method is preferred because the auger is heavy and separating it from the auger truck can be a dangerous and cumbersome procedure for workers. In particular, as the Kelly bar generally extends through most of the central shaft of the auger, the Kelly bar must be slid from within the auger to separate the auger from the derrick. Further, even if the auger is attached to the distal end of the Kelly bar, the attachment for the auger is at the top end of the auger, so a worker must reach up over the auger to reach the connector, or rotate the auger relative to the derrick (which is not a natural position for the auger to hang and requires supporting its entire weight) to reach the connector holding the auger in place. Further, even if the auger can be supported by the workers when disconnected, the derrick will often lack fine motor control and will only be able to pull the Kelly bar upward requiring the workers to adjust the auger to a new position after disconnecting it to allow the Kelly bar to be freed which is both difficult and dangerous.

Once the auger has been removed, a combination of devices for attaching the Kelly bar to the anchor (10) would be used. One such set of devices of the prior art is shown in FIG. 2. The design and operation of such devices is discussed at length in U.S. Pat. No. 3,377,077, the entire disclosure of which is herein incorporated by reference, but a general overview will be given here. The device comprises a connector (50) for connecting the Kelly bar to the locking dog (200) which in turn connects to a torque tube (60). The locking dog (200) includes a sleeve (207) attached to a bolt flange (205). The sleeve (207) includes a non-circular, generally polygonal bore (209) thereinto. The non-circular cross-section of the bore (209) is utilized to prevent the torque tube (60), when placed into the bore (209) in a socketing type of arrangement, from rotating relative to the bore (209). By convention, the bore (209) is usually square in cross-section.

The torque tube (60) is generally fixed in position through a combination of cross-sectional shape and the inclusion of a pin locking mechanism in the locking dog (200). The torque tube (60) includes two holes (61) through its outer surface and located towards its upper end (63). The locking dog (100) includes a pair of laterally extending sleeves (211) and (213), each of which includes a spring biased pin (221) and (223) located within each lateral sleeve (211) and (213), and normally biased inwardly so that one end of each pin extends into the bore (209). Rings (231) and (233) or other grasping aids may be provided upon pins (221) and (223) to facilitate a worker in pulling them outwardly, against the biasing. There may also be locking mechanisms provided to hold the pins (221) and (223) in an outward position.

Each of the two pins (221) and (223) extends into the bore (209) of the locking dog (200) a predetermined distance at a first position to which it is naturally biased. Further, each of the pins (221) and (223) may be retracted and held in two different positions by pulling on the ring (231) or (233) and rotating the pin (221) or (223) to engage the lock. In a second position, the pin (221) or (223) is partially retracted from the bore (209), and in a third position the pin (221) or (223) is fully retracted from the bore (209). Each pin (221) and (223) will generally also include a slanted face (225) which extends from the innermost end of the pin (221) or (223) to a point along the pin's (221) or (223) length prior to the other end. When in the first position this point along the pin's (221) or (223) length is within the bore (209) providing for a small ring (291) of the pin to interact with the torque tube (60).

To mount the anchor (10) to the derrick in preparation for installation, the torque tube (60) is first placed into the bore (209) of the locking dog (200) with the pins (221) and (223) at their third (released or outermost) position. While holding the torque tube (60) in place in the bore (209), a worker will reach to the upper end (63) of the torque tube (60) and release the pins (221) and (223) to their first position which allows them to pass into the bore (209) and through the holes (61) in the torque tube (60). With the torque tube (60) so secured to the locking dog (200), the guy rod (15) is then threaded into the lower end (65) of the torque tube (60). As the guy rod (15) is threaded through the torque tube (60), the upper end (14) of the guy rod (15) will contact the slanted faces (225) of the pins (221) and (223) forcing them to move from the first position toward their second (or even third) position. The shoulder (21) will do the same when it contacts the slanted faces (225). It should be apparent that so long as the guy rod (15) fits inside the torque tube (60), this movement will not allow the locking dog (200) to release the torque tube (60) as the pins (221) and (223) will always be at least partially within the holes (61) in the torque tube (60). Once the shoulder (21) passes over the pins (221) and (223), the pins (221) and (223) will be biased back under the shoulder (21) allowing the anchor (10) to be supported by the pins (221) and (223) and therefore attached to the locking dog (200).

At the time this attachment occurs, torque tube (60) will have preferably mated with a device of similar shape to the torque tube (60) above the screw flange (11) on the anchor (10). This mating will generally result in one of the two pieces socketing into the other. As the torque tube (60) and this device preferably also have non-circular cross-sections, this socketing connection prevents the anchor (10) from rotating relative to the torque tube (60) allowing the rotational motion imparted on the torque tube (60) by the rotation of the locking dog (200) to be transferred to the anchor (10).

The anchor is then installed by activating the rotary movement of the auger truck's motor and boring the anchor into the ground using a screwing or drilling type action. Once the screw flange (11) is at the desired depth, the rotary motion provided by the auger truck will be stopped. The pins (221) and (223) will then be retracted to their second position which will free the guy rod (15) but not the torque tube (60) and the auger truck will lift the derrick pulling the torque tube (60) free of the guy rod (15). Once free, the guy rod (15) will generally be capped with an eyelet to cover the externally threaded shaft (19), and the anchor (10) is ready to be used. To lay another anchor (10), the pins (221) and (223) are returned to their first position and the next anchor's (10) guy rod (15) is threaded through the torque tube (60) as discussed above and the process is repeated.

While this process for laying anchors (10) has been used for many years, there are significant steps which are both cumbersome and dangerous in its performance. For one, the necessary removal of the auger to install the anchors is a difficult and potentially dangerous task, particularly if the auger cannot be stored by drilling into an open patch of earth as it requires the workers to support the full weight of the auger while the auger is disconnected from the derrick and the Kelly bar is removed. Further, the removal of the Kelly bar from the auger is performed by the truck. As the derrick is motor driven and lacks fine motor control in most cases, an unexpected movement of the derrick can cause unintended movement of the auger which can be a potentially dangerous situation to those who are supporting it.

Further, seating the torque tube (60) in the locking dog (200) bore (209) is unnecessarily cumbersome as the worker has to reach up and manually release the pins (221) and (223) from their third position to their first while holding the torque tube (60) in place. As the torque tube (60) is generally about 4 feet or more in length, this can be very difficult.

SUMMARY OF THE INVENTION

Described herein are embodiments of adapters that may be attached directly to the pilot bit hole of an auger. The adapter may then in turn be attached to a locking dog assembly, foundation anchor drive tool, or in conjunction with a mechanical torque indicator, shear pin torque indicator, or similar device to install an anchor.

In an alternative embodiment, the adapter may include structures comprising the necessary components of a locking dog assembly combined with the connector forming a single unit called a pilot hole locking dog.

The adapter attachment may facilitate the application of extensions, which may connect directly to the pilot bit hole of the auger.

Described herein, in an embodiment is an adapter for allowing an earth anchor to be installed by an auger truck without removal of the auger, the adapter comprising: a connecting shaft, the shaft being sized and shaped to be placed into a pilot bit hole in the auger when the pilot bit is removed; and a bolt flange connected to the connecting shaft, the bolt flange being sized and shaped to interface with a mating bolt flange.

In an embodiment of the adapter, a spacer may be placed between the connecting shaft and the bolt flange.

In an embodiment of the adapter the bolt flange is temporarily attached to the mating bolt flange such as by having bolts placed through holes in the bolt flange and holes in the mating bolt flange or may be permanently attached to the mating bolt flange such as by welding the bolt flange and the mating bolt flange together.

In an embodiment of the adapter, the connecting shaft may have a non-circular cross-section which may comprise a main shaft; and two laterally spaced flanges arranged on opposing sides of the main shaft, where the main shaft may including a cross-section comprising two linear and two rounded sides or an aperture which may be in angular relation to the two laterally spaced flanges.

In an embodiment of the adapter, the mating bolt flange may be on a locking dog, a foundation drive tool, a mechanical torque indicator, or a shear pin torque indicator.

In another embodiment, there is disclosed an adapter for allowing an earth anchor to be installed by an auger truck without the removal of the auger, the adapter comprising: means for connecting the adapter directly to a pilot bit hole in the auger when the pilot bit is removed; and means for connecting the adapter to a locking dog used for installing anchors.

In a still further embodiment there is disclosed a pilot hole locking dog comprising: a connecting shaft, the shaft being sized and shaped to be placed into a pilot bit hole in the auger when the pilot bit is removed; a sleeve having a bore therein; a lateral extension shaft extending from the sleeve;

and a pin having two ends and a length; wherein the pin is supported within the lateral extension shaft; wherein the pin is biased so that one of the at least to ends extends into the bore; and wherein the pin has a slanted surface cutting across the major axis of the pin from the end that extends into the bore to a point along the length of the pin which may be outside of the bore.

DETAILED DESCRIPTION OF THE PREFERRED EMBODIMENTS

Figure 3:
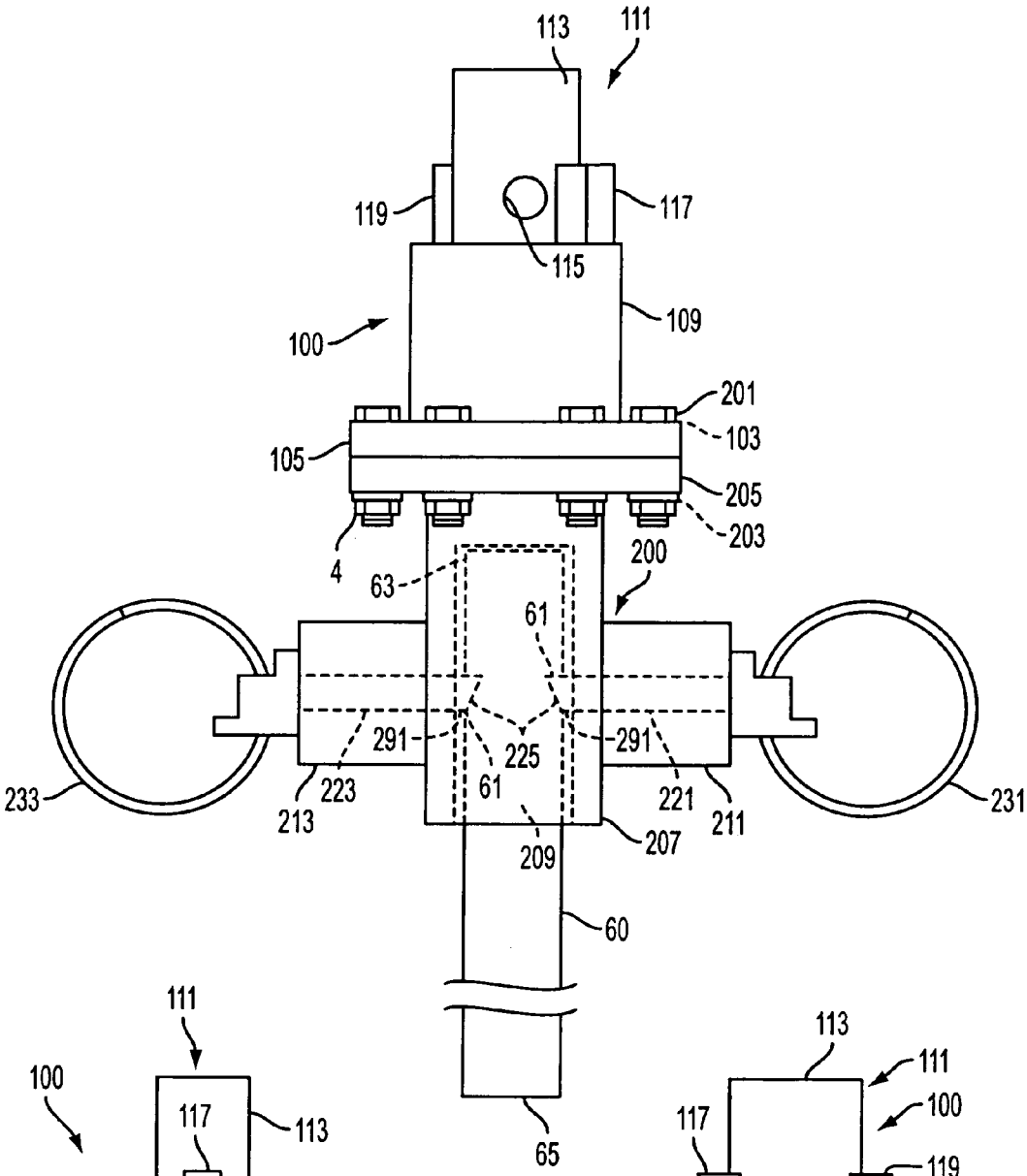
FIG. 3 is a front view of an embodiment of an adapter useable with the auger in place, the adapter is attached in FIG. 3 to an embodiment of a prior art locking dog and torque tube.
Figure 4:
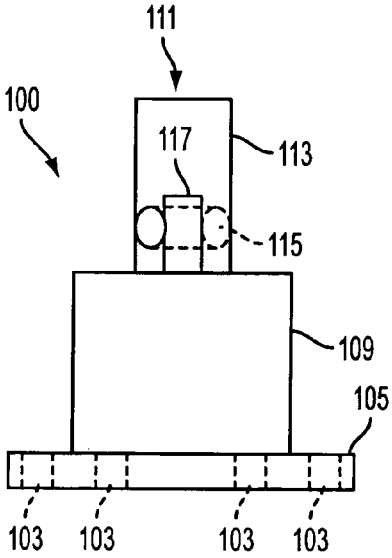
FIG. 4 is a side view of the adapter of FIG. 3.
Figure 5:
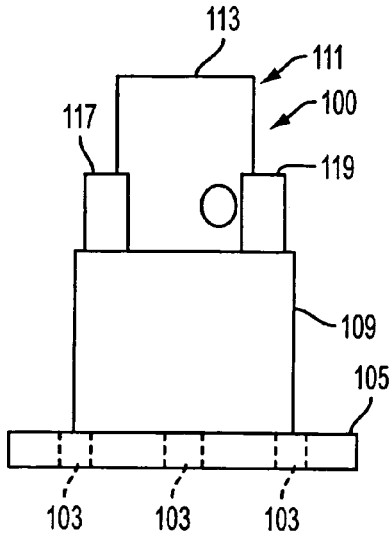
FIG. 5 is a back view of the adapter of FIG. 3.
Figure 6:
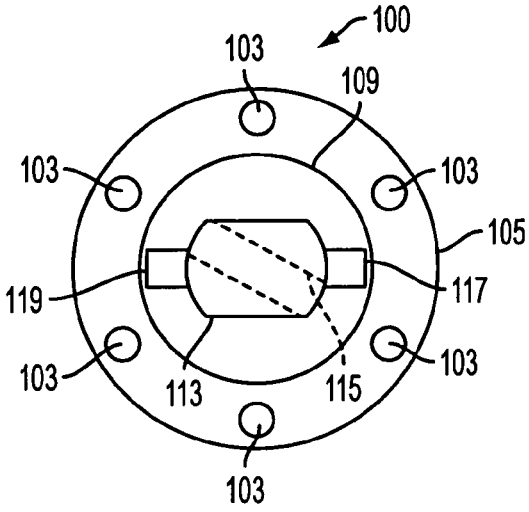
FIG. 6 is a top view of the adapter of FIG. 3.
Figure 7:
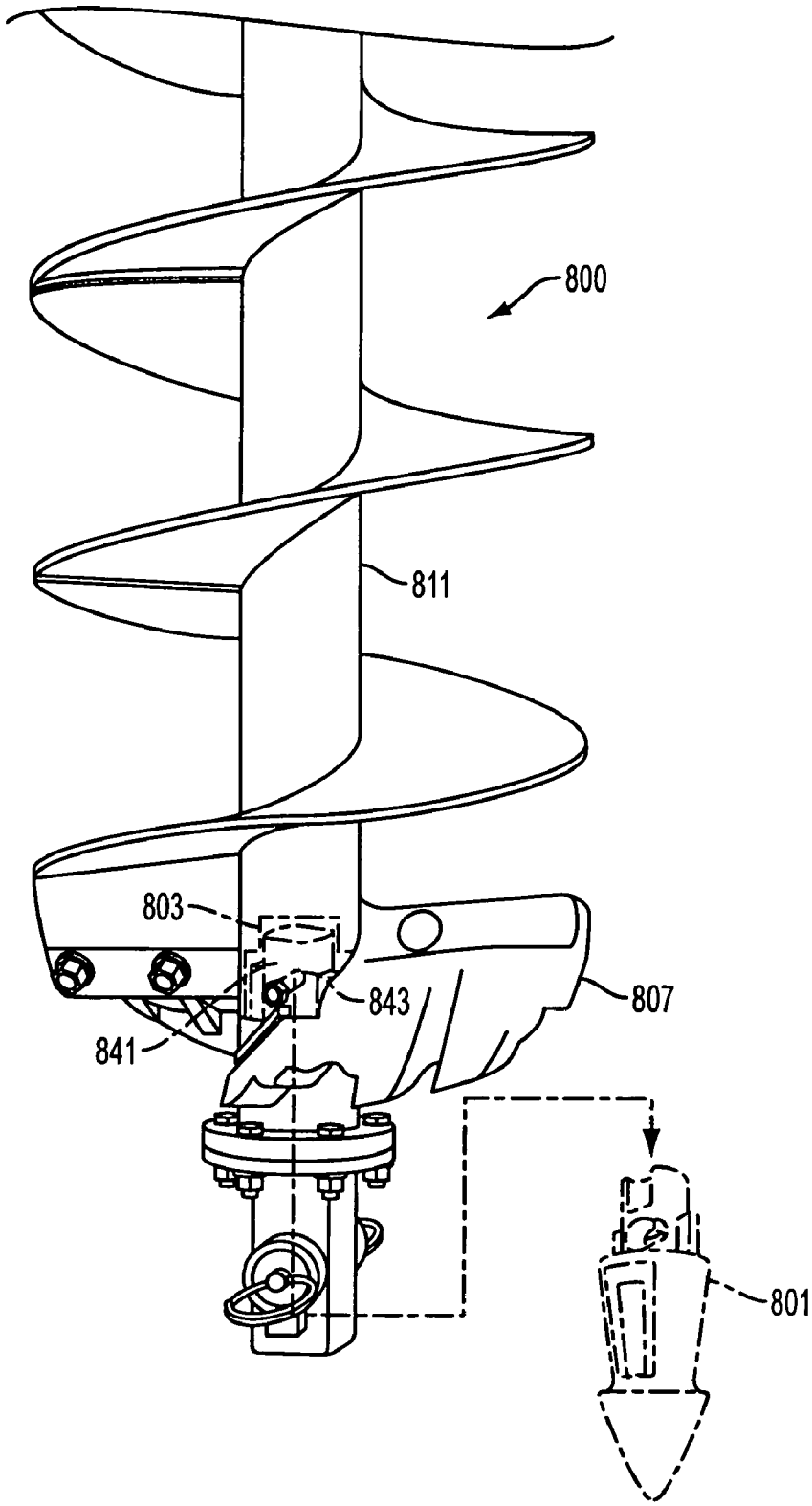
FIG. 7 depicts the embodiment of the adapter and locking dog assembly of FIG. 3 in place in an auger's pilot bit hole.
Figure 8:
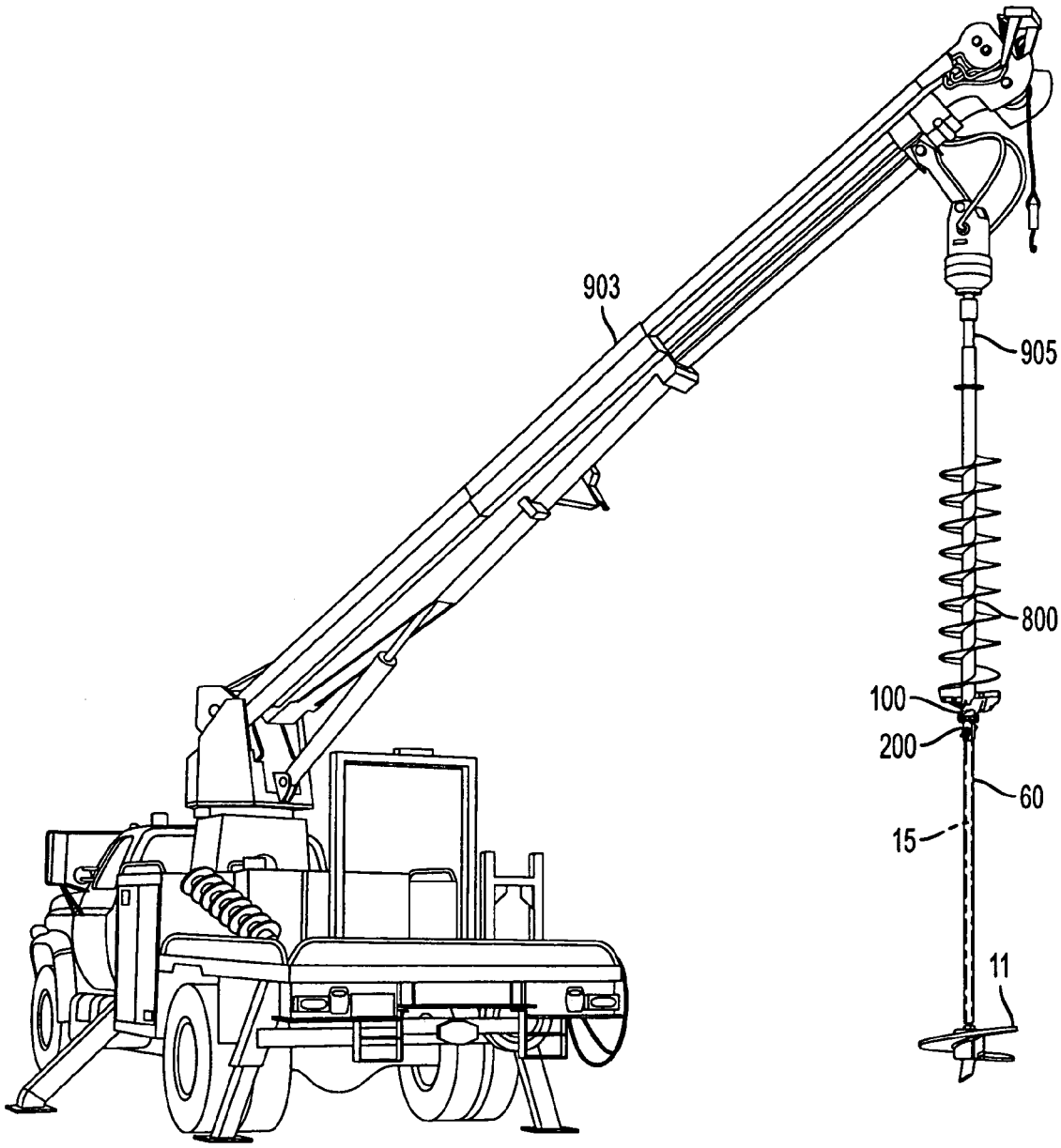
FIG. 8 depicts an embodiment of a utility truck configured with the embodiment of an adapter and locking dog shown in FIG. 3, and an anchor ready for installation.

Depicted in FIGS. 3-6, is an embodiment of an adapter (100) for connecting to the pilot bit hole (803) of an auger (800). The adapter (100) is shown connected to a locking dog (200) of the type known to the prior art in FIG. 3. FIGS. 4-6 show the adapter on its own with the locking dog (200) not present. FIGS. 7-8 show the embodiment of the adapter (100) of FIGS. 3-6 along with the locking dog assembly (200) attached to an auger (800).

The adapter (100), in the depicted embodiment of FIGS. 3-6 is preferably constructed of metal or another strong and resilient material. The adapter (100) will generally placed under significant torque when used to install the anchor and the adapter will generally need to be constructed of materials that can handle normal operational torque without concern for the adapter (100) breaking or shearing. The adapter (100) of the depicted embodiment comprises three main components: the connecting shaft (111), the spacer (109) and the bolt flange (105).

Figure 1:
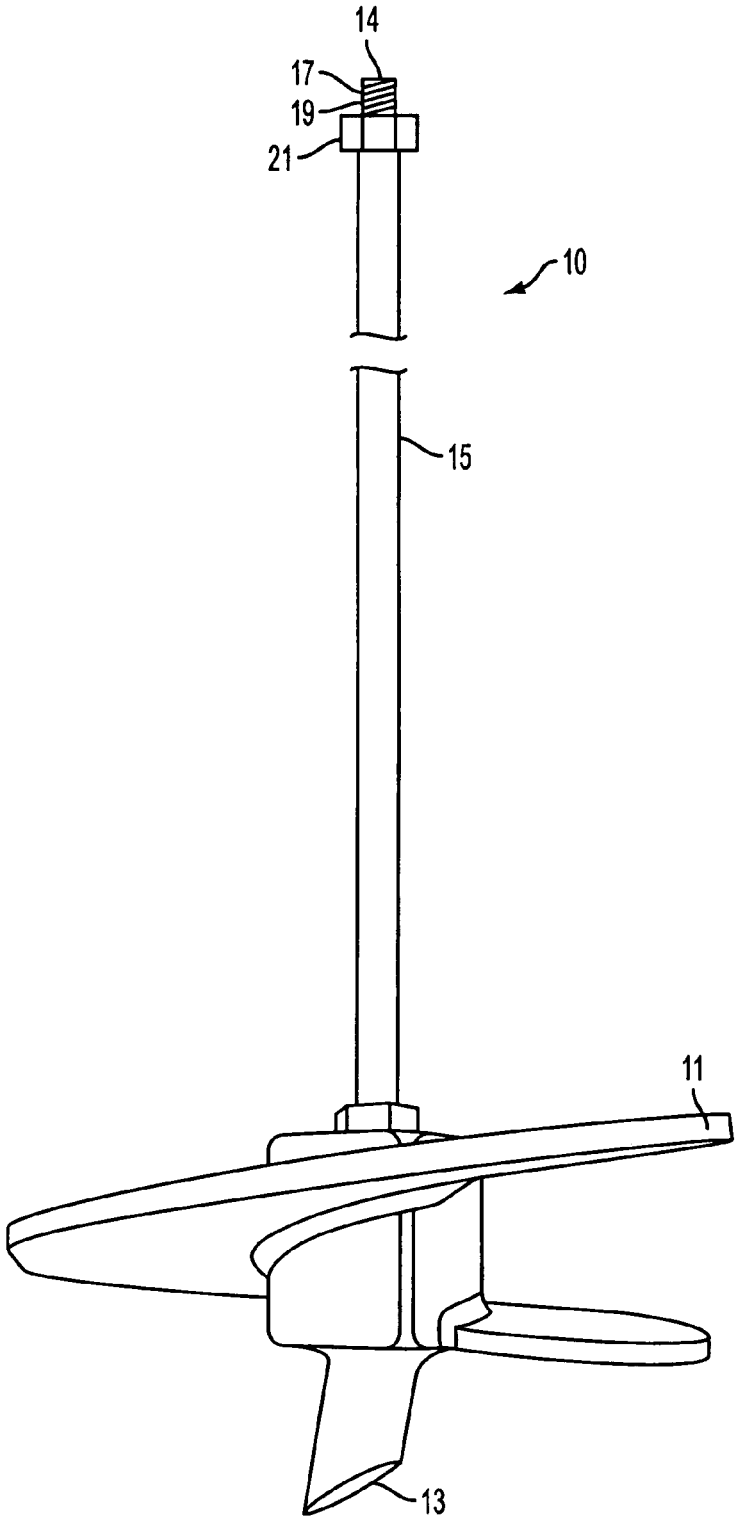
FIG. 1 PRIOR ART
FIG. 1 is a front view of a screw type anchor of the prior art.
Figure 2:
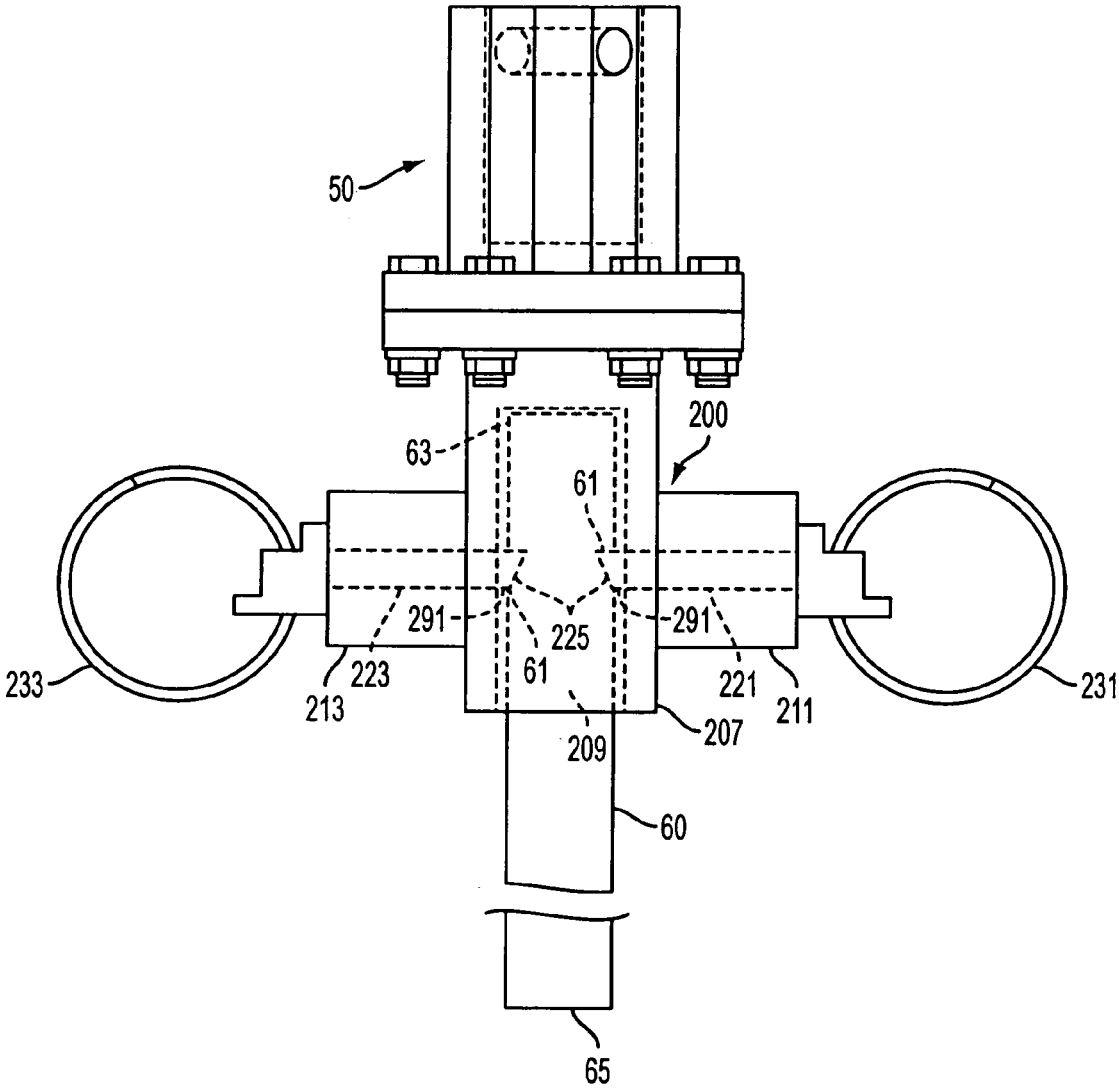
FIG. 2 PRIOR ART
FIG. 2 is a front view of a Kelly bar connector and locking dog assembly of the prior art.

The bolt flange (105) includes a plurality of holes (103) therethrough. The bolt flange (105) is sized and shaped to interface with the locking dog (200) which has a corresponding bolt flange (205) (a mating bolt flange) with holes (203) as shown in FIG. 3. The locking dog (200) is depicted in FIG. 3 as being attached to the adapter (100) through a series of fasteners, such as bolts (201) placed through holes (103) in the bolt flange (105) of the adapter (100) and corresponding holes (203) in the bolt flange (105) of the locking dog (200). This connection may correspond to the type of connection that the locking dog (200) would have made to a connector (50) of the prior art as shown in FIG. 2 and therefore, in an embodiment, no modification of the locking dog (200) would be required to use the locking dog (200) with the adapter (100).

It should be clear from the depiction of FIG. 3 that the connection of the adapter (100) to a locking dog (200) is merely an exemplary embodiment of what may be attached to the adapter (100). Any object which could have been attached to the connector (50) could be attached to the adapter (100) as it would include a mating bolt flange for attachment to bolt flange (105). These objects include, but are not limited to, foundation drive tools, mechanical torque indicators, and shear pin torque indicators. Still further, the prior art connector (50) could also be attached to the adapter (100). This type of arrangement could be used to use the prior art connector (50) and a Kelly bar as an extension such as is discussed later in a related embodiment using two adapters (100).

The adapter (100) in the depicted embodiment also includes a spacer (109) which is attached to and generally centered upon the bolt flange (105). In the depicted embodiment, the spacer (109) comprises a hollow cylinder of material welded or otherwise ruggedly attached to the bolt flange (105). The cylindrical shape is by no means required, however, and the spacer (109) could be of any shape. Further, a hollow structure is preferred for the spacer (109) as it decreases the adapter's total weight, but the spacer (109) can be solid or hollow depending on the embodiment and the strength of the spacer (109).

By Examining FIG. 7, it is apparent that the spacer (109) spaces the bolt flange (105) sufficiently below the pilot bit hole (803) so that the bolt flange (105) does not contact any portion of the teeth (807) of the auger (800) as the bolt flange (105) will generally have a greater diameter than the pilot bit (801). This prevents any damage to the teeth (807) from contact with the adapter (100) by eliminating contact between the adapter (100) and the teeth and only allowing the adapter (100) to contact the same surfaces contacted by the pilot bit (801). In an alternative embodiment, the spacer (109) may be totally eliminated as unnecessary and the connecting shaft (111) may connect directly to the bolt flange (105). This may be by lengthening the connecting shaft (111) to the point where the bolt flange (105) is held in spaced relationship, or may be because the bolt flange (105) is sized to fit within the auger (800) teeth (807). In a still further embodiment, the bolt flange (105) may contact the auger (800) teeth (807) or be partially retained against the auger (800) teeth (807).

Also attached to the spacer (109), generally at the end opposing the bolt flange (105), is a connecting shaft (111). The connecting shaft (111) provides the ability to connect the adapter (100) to the pilot bit hole (803) of the auger (800) using a socketing type of arrangement. In the auger (800) as shown FIG. 7, there is a pilot bit hole (803) located at the boring end (821) of the auger (800). When the auger (800) is used to bore a hole, the pilot bit hole (803) will have mounted therein a pilot bit (801) designed to provide for the initial alignment and placement of the auger (800) and to aid the drilling operation. As also shown in FIG. 7, this pilot bit (801) can be removed which provides for the pilot bit hole (803) to be available for use by the adapter (100). The adapter (100) is connected to this pilot bit hole (803) by sliding the connecting shaft (111) into the pilot bit hole (803) in generally the same way as the pilot bit (801) was slid into the pilot bit hole (803).

In the depicted embodiment, so as to provide for a resilient connection between the adapter (100) and the pilot bit hole (803), the connecting shaft (111) comprises three portions which are a main shaft (113), of generally non-circular cross section, and two lateral flanges (117) and (119) which are arranged on opposing sides of the main shaft (113)

and are conjoined to the main shaft (113). The main shaft (113) is more preferably arranged to have a cross-section having two rounded sides and two generally linear sides with each flange having a generally curved four sided shape which corresponds to the cross-section of the pilot bit hole (803) providing that the connector (111) fits snugly in the pilot bit hole. This cross-sectional shape of the connecting shaft (111) also is preferred as it can generally be rotated about its axis by the pilot bit hole (803) into which it is socketed without slippage. The length of the connecting shaft (111) is preferably chosen so that the connecting shaft (111) fills most of the available space in the pilot bit hole (803). In this way the upper surface (191) of the spacer (109) sits generally flush against the lip (831) of the pilot bit hole (803). This arrangement can help prevent the connecting shaft (111) from "rocking" back and forth in the pilot bit hole (803) in any significant way when the auger (800) is rotating.

The main shaft (113) of the connecting shaft (111) also preferably includes an aperture (115) therethrough. The aperture (115) through the main shaft (113) of the connecting shaft (111), is preferably angulated relative to the connecting points of the lateral flanges (117) and (119), so that a bolt or other fastener can be secured therethrough and so that torque on the connecting shaft (111) cannot easily shear the fastener. Such a fastener-through-hole arrangement is the standard mechanism for attaching the pilot bit (801) into the pilot bit hole (803) where the central shaft (811) of the auger (800) has corresponding holes (841) and (843) to intersect the pilot bit hole (803) allowing for the fastener to be used to hold the adapter (100) inside the pilot bit hole (803). Therefore, the adapter (100) may be attached to the pilot bit hole (803) in the auger (800) in the same way that the pilot bit (801) is attached thereto. It would be recognized by one of ordinary skill in the art that the design of the connecting shaft would be selected based on the auger's (800) pilot bit hole (803) shape and connection to the pilot bit (801) if an alternative shape and connection was used in the auger (800).

To understand the use and operation of the adapter (100), it is desirable to look at how the adapter (100) is used in conjunction with existing components to install the anchor (10). As discussed in the background section, prior attachment to the locking dog (200), required the auger (800) to be removed from the derrick (903) to expose the complete Kelly bar (905) and a connector (50) was attached to the Kelly bar (905) to which the locking dog (200) was in turn attached. The adapter (100) eliminates the need to expose the Kelly bar (905) and therefore to remove the auger (800) as the adapter (100) attaches directly to the boring end (821) of the auger (100) in place of the pilot bit (801). Therefore, when a worker has finished drilling the hole and placing the pole and is ready to install anchors (10), the derrick (903) can simply lift the auger (800) to a convenient point and the work team can remove the pilot bit (801) from the pilot bit hole (803) in the auger (800). The pilot bit (801) is significantly lighter than the auger (800) and is easily removed by one person by hand. With the pilot bit (801) removed (as in FIG. 7), the adapter (100) is placed within the, now empty, pilot bit hole (803) and attached by placing a bolt or pin used to attach the pilot bit (801) in the pilot bit hole (803) through the holes (841) and (843) in the auger (803) and the hole (115).

The locking dog (200) will generally have been previously attached to the bolt flange (105) of the adapter (100) prior to the adapter (100) being installed in the pilot bit hole (803), but may be attached once the adapter (100) is in place in the pilot bit hole (803). Once the locking dog (200) is attached, the derrick (903) will be raised and the worker can load the torque tube (60) and anchor (10) into the locking dog (200) in the same way s/he would if the locking dog (200) was connected to connector (50).

Once the anchor (10) is positioned to be installed as shown in FIG. 8, the derrick (903) will be moved into position and the anchor (10) will be installed. As should be apparent, when the anchor (10) is placed using the adapter (100) the auger (800) has not been removed from the derrick (903) and it is still attached as shown in FIG. 8. The locking dog (200), anchor (10), and torque tube (60) are all located below the auger (800) during the installation. The auger (800) will therefore be rotating in space during anchor (10) installation. The arrangement of the components in preparation for anchor placement is shown by FIG. 8 which shows the auger truck (900) with the derrick (903) raised, and the auger (800), adapter (100), locking dog (200), torque tube (60), and anchor (10) in place ready for anchor (10) installation.

Figure 9:
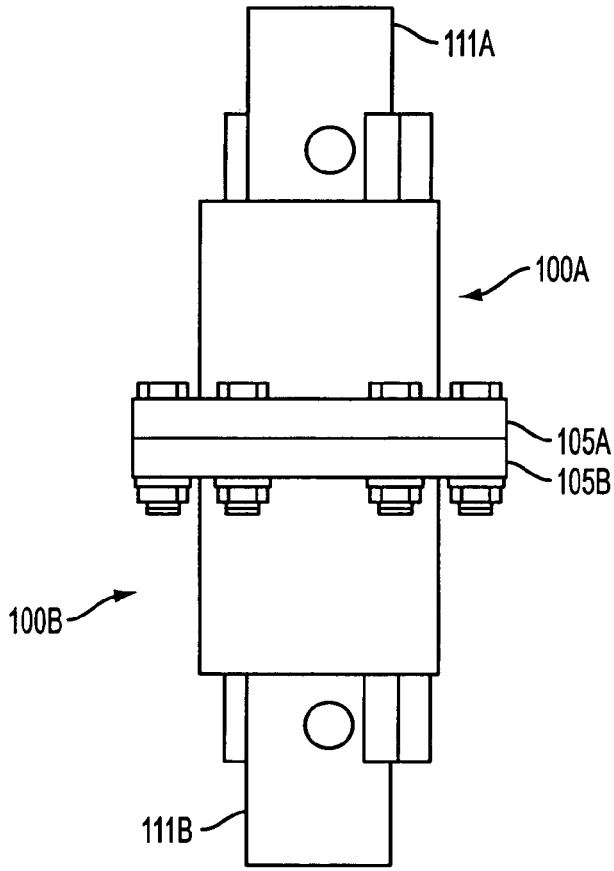
FIG. 9 shows a front view of a pair of the embodiments of adapters shown in FIGS. 3-6 secured back-to-back a torque tube.

FIG. 9 shows an alternative way of using the adapter (100). In this embodiment, an adapter (100A) is attached by its bolt flange (105A) to the bolt flange (105B) of another identical adapter (100B) which has been inverted. The second adapter (100B) may in turn be attached to an extension bar (not shown) using the connecting shaft (111B) which could in turn be connected to another adapter (not shown) using its connecting shaft (not shown). The locking dog assembly (200) may then be attached to this last adapter (not shown). This arrangement can provide for an easy way to provide extensions for the derrick (803) if the auger (800) is not of sufficient length for installation of the anchor (10) or if the anchor (10) is being installed in such a way where the auger (800) could hit the ground during anchor (10) installation.

Figure 10:
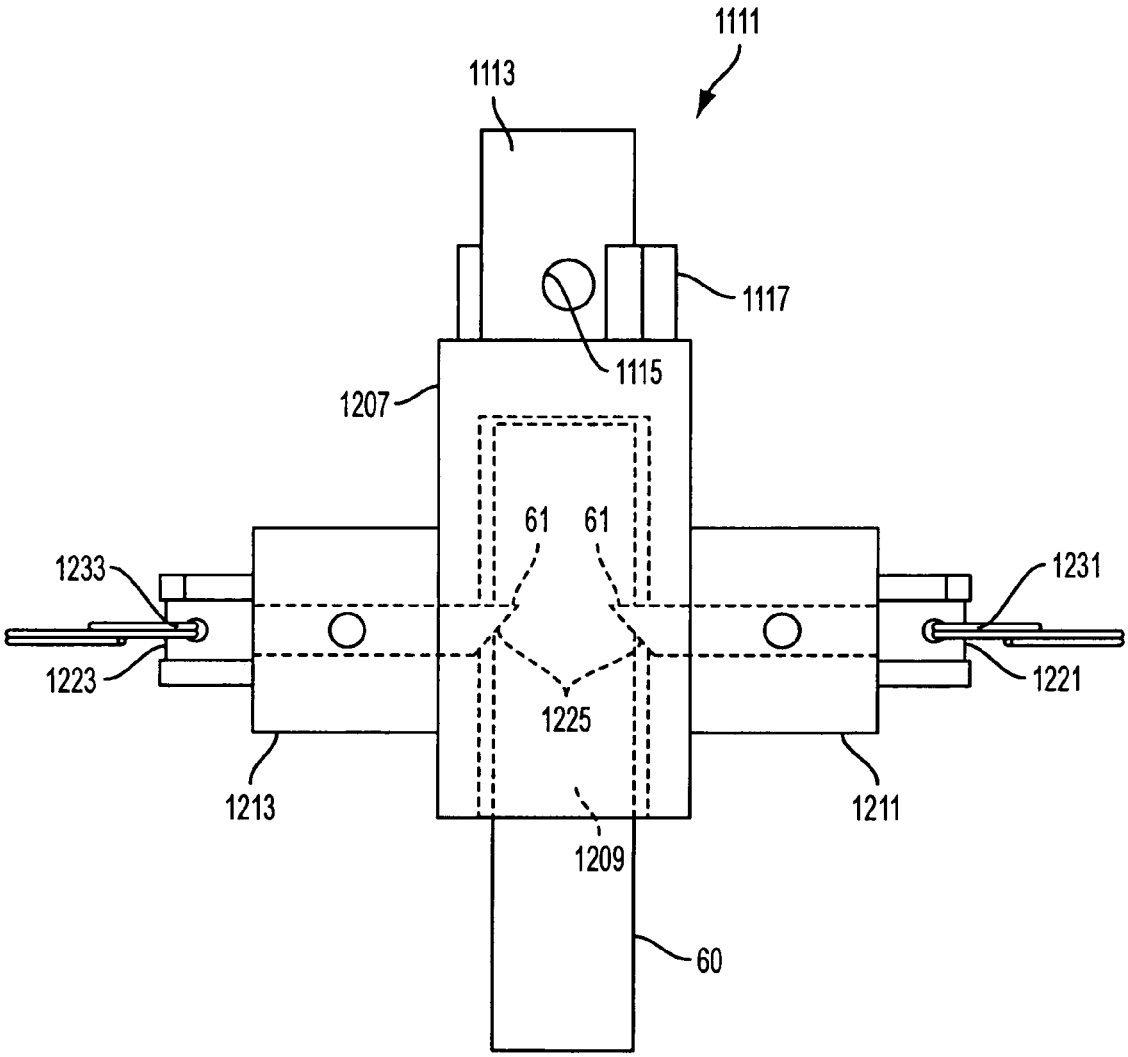
FIG. 10 shows a front view of a pilot hole locking dog.

In a further embodiment of adapters for use with the pilot bit hole (803), the connecting shaft (111) of the adapter (100) may be combined directly with components of the locking dog (200) to form a one piece unit which is called a pilot hole locking dog (1000). Alternatively, the pilot hole locking dog (1000) may be manufactured as a single unit. An embodiment of such a one piece device is shown in FIG. 10. In its simplest form, this can be accomplished by permanently attaching the bolt flange (205) of the locking dog (200) to the bolt flange (105) of the adapter (100). This may be performed in any manner such as, but not limited to, welding the two bolt flanges (105) and (205) together.

FIG. 10 provides a pilot hole locking dog (1000) having a connecting shaft (1111) of a generally similar size and shape to the connecting shaft (111) provided on the uppermost end of the pilot hole locking dog (1000). This connecting shaft (1111), like connecting shaft (111) is also sized and shaped to interface with the pilot bit hole (803) of the auger (800). In place of the spacer (109), however, the pilot hole locking dog (1000) includes a sleeve (1207) having a generally polygonal bore (1209) therein. Further, the pilot hole locking dog (1000) includes lateral extension sleeves (1211) and (1213) and spring biased pins (1221) and (1223) similar to those on the prior art locking dog (200). In the depicted embodiment, these structures will work in essentially the same way as they do in the locking dog assembly (200) of the prior art. Therefore, in this embodiment the construction of FIG. 3 which comprised the adapter (100) and locking dog (200) has been superseded by the pilot hole locking dog (1000) which combined the functionality of the two pieces into an entirely new structure which is a single piece allowing essentially direct connection from the auger (800) to the anchor (10) and torque tube (60).

The embodiment of FIG. 10 may be preferred as the pilot hole locking dog (1000) will often be of lighter weight and more compact construction than the adapter (100) and locking dog (200) and will allow for replacement of multiple components, however, many workers which install anchors (10) will already have a locking dog (200) of the prior art for installing anchors using the connector (50) of the prior art, so the option to continue use of that existing locking dog by using the adapter (100) provides for an alternative and possibly more cost effective choice in some cases.

While the embodiment of FIG. 10 generally operates in a similar manner to the locking dog (200) in connecting to the torque tube (60) and anchor (10), the embodiment of FIG. 10 also includes an improved alternative design of pins (1221) and (1223). These pins (1221) and (1223) may be used with the pilot hole locking dog (1000) as shown in FIG. 10, but may alternatively be used to replace the pins (221) and (223) of the locking dog (200) of the prior art (which are generally included as a part of a removable and modular component) to improve its operation. As can be seen in FIG. 2, in the prior art locking dog (200), the pins (221) and (223) must be completely retracted to their first position to allow the torque tube (60) to be placed into the hollow bore (209). The pins (221) and (223) must then be released to their first position manually to allow for the torque tube (60) to be locked into place. This can be a difficult procedure and necessarily limits the maximum length of the torque tube (60) as the worker needs to be able to reach the locking dog (200) with the torque tube (60) in place. This limitation is due to design of the prior art pins (221) and (223) which had a circular ring (291) of the pins (221) and (223) main section behind the slanted face (225) to insure that the pins (221) and (223) are always in contact with the inner surface of the holes (61) in the torque tube (60). This ring (291) is unnecessary to provide for firm attachment. The pins (1221) and (1223) in FIG. 10 have eliminated the ring (291) and extended the slanted face (1225) of the pins (221) and (223) so that the point where the slanted face (1225) intersects the length of the pin (1221) or (1223) outside of the bore (1209). This allows the torque tube (60) to be essentially press fitted into the bore (1209) without need of the operator to manually move the pins (221) and (223) to their third position. In particular, as the torque tube (60) is pushed into the bore (1209) in the same way as the guy rod (16), the end of the torque tube (60) will cause the pins (221) and (223) to retract against their biasing as the torque tube (60) pushes against the slanted face (1225). Once the holes (61) in the torque tube (60) line up with the pins (1221) and (1223), the pins (1221) and (1223) will be biased into the first position and through the holes (61), locking the torque tube (60) in place in the bore (1209). This allows for any length of torque tube (60) to be easily used which can enable deeper anchor installation to be performed much easier.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A pilot hole locking dog comprising:

a connecting shaft comprising a main shaft and two lateral flanges conjoined to said main shaft and arranged on opposing sides of said main shaft;

a sleeve having a bore therein, said sleeve connected to said connecting shaft;

a lateral extension shaft extending from said sleeve; and a pin having two ends and a length;

wherein said pin is supported within said lateral extension shaft;

wherein said pin is biased so that one of said at least two ends extends into said bore; and wherein said pin has a slanted surface cutting across the major axis of said pin from said end that extends into said bore to a point along said length of said pin.

2. The pilot hole locking dog of claim 1 wherein said point along said length of said pin is biased to be outside said bore.

3. The pilot hole locking dog of claim 1 wherein said main shaft has a non-circular cross-section.

4. The pilot hole locking dog of claim 3 wherein said main shaft has a cross section with two rounded sides and two generally linear sides.

5. The pilot hole locking dog of claim 4 wherein said lateral flanges are connected to said rounded sides of said main shaft.

6. A device for installing an earth anchor, the device comprising:

an auger including a pilot bit hole;

a locking dog, said locking dog including:

a connecting shaft, said shaft being placed within said pilot bit hole and secured to said auger;

a sleeve having a bore therein;

a lateral extension shaft extending from said sleeve; and a pin having two ends and a length;

wherein said pin is supported within said lateral extension shaft;

wherein said pin is biased so that one of said at least two ends extends into said bore; and wherein said pin has a slanted surface cutting across the major axis of said pin from said end that extends into said bore to a point along said length of said pin.

7. The pilot hole locking dog of claim 6 wherein said point along said length of said pin is biased to be outside said bore.

8. The pilot hole locking dog of claim 6 wherein said main shaft has a non-circular cross-section.

9. The pilot hole locking dog of claim 8 wherein said main shaft has a cross section with two rounded sides and two generally linear sides.

10. The pilot hole locking dog of claim 9 wherein said lateral flanges are connected to said rounded sides of said main shaft.

* * * * *